United States Patent [19]

Sherwin

[11] 4,113,275

[45] Sep. 12, 1978

[54] SKI BOOT HEEL RESTRAINING APPARATUS

[75] Inventor: William Claude Sherwin, Salt Lake City, Utah

[73] Assignee: Nortec Inc., Salt Lake City, Utah

[21] Appl. No.: 731,558

[22] Filed: Oct. 12, 1976

[51] Int. Cl.[2] ..... A63C 9/18

[52] U.S. Cl. ..... 280/615

[58] Field of Search ..... 280/615, 618, 11.37 E, 280/607, 636; 9/310 R, 310 AA

[56] References Cited

U.S. PATENT DOCUMENTS

| | | | |
|---|---|---|---|
| 3,775,866 | 12/1973 | Marker | 280/615 X |
| 4,008,908 | 2/1977 | Pierson | 280/636 |

FOREIGN PATENT DOCUMENTS

| | | | |
|---|---|---|---|
| 173,649 | 6/1952 | Austria | 280/618 |
| 292,861 | 7/1916 | Austria | 280/618 |

*Primary Examiner*—Joseph F. Peters, Jr.
*Assistant Examiner*—Gene A. Church
*Attorney, Agent, or Firm*—A. Ray Osburn

[57] ABSTRACT

An improvement for cross country ski bindings comprising apparatus for preventing lateral motion of the heel of a cross country ski boot with respect to the ski when the heel is lowered into close proximity with the surface of the ski. The apparatus may comprise 2 pivotal vertical members between which the heel of the boot fits, the vertical members being, in accordance with one aspect of the disclosure, biased apart from each other so that the heel enters freely therebetween, the weight of the skier then, applied to the heel of the boot, causing the vertical members to move closer together to grip the heel of the boot. Thus the heel is firmly held in a central location on the ski. When it is desired to raise the heel of the boot, the vertical members are biased outwardly to release the heel. In accordance with another aspect of the disclosure the vertical members are rigidly communicated with the top surface of the ski, being widelv enough disposed so that the heel of the boot fits loosely therebetween. With this aspect of the disclosure lateral movement of the heel is essentially restrained and the heel may be raised from the ski without impediment thereto. The disclosed apparatus thus provide for use of cross country skis with greater efficiency and facility, especially for the novice or beginning skier. Further, the ski incorporating the present invention may be used under a variety of snow and grade conditions without manual adjustment or manual attachment and detachment of the heel to the ski.

10 Claims, 7 Drawing Figures

SKI BOOT HEEL RESTRAINING APPARATUS

BACKGROUND

1. FIELD OF INVENTION

The present invention relates broadly to the binding of ski boots to skis and more particularly to the binding of ski boots to cross country skis. With still more particularity, the present invention relates to restraint of unwanted motions of the heel of a cross country ski boot with respect to a cross country ski.

2. PRIOR ART

With downhill skis, it is desirable that the ski boot be firmly and substantially immoveably attached to the ski boot at its toe and at its heel, so that the skier may substantially control the orientation skis as he travels downhill under the influence of gravity. The bindings securing the boot to the ski for downhill skiing should release in the event of dangerous levels of stress applied to the ankle or legs of the skier, and the art of such ski bindings is well advanced so that the danger of injury to the skier is reduced in the event of spills and the like. The use of cross country and mountaineer skis contrasts with the use of downhill skis, in that the heel of the ski boot must be free to move vertically with respect to the ski, so that the skier may stride forward to propel the skis and the skier along the surface of the snow. Such forward striding requires that the heel be free to move vertically with respect to the ski. Cross country ski boots and the like are therefore typically relatively flexible in contrast to the substantially rigid downhill ski boots, and are fastened firmly to the ski only at their toes. In the course of propelling himself along the snow upon the skis, the cross country skier must alternately place substantially his entire weight upon the approximate center of the ski, the bottom of which is adapted to provide the necessary friction. In this aspect of the use of cross country skis, it is extremely desirable that the foot be aligned generally axially with the ski.

Heretofore, no effective apparatus has been provided to effectively prevent the tendency toward rotation of the ski boot heel laterally in respect to the ski. This has resulted in considerable difficulty for the skier to keep his foot aligned over the ski to provide the necessary traction for forward motion and to easily keep the skis aligned in a parallel forward orientation to facilitate his travel along the surface of the snow. With the present bindings, further difficulty arises when the cross country skier coasts downhill in that the skier can exercise less than desirable control over the skis to control either his downhill velocity or his direction of downhill motion. To partially obviate the aforesaid problems some bindings for the heel of cross country ski boots have provided for the manual selection between substantially full restraint of the heel in both the lateral and vertical directions and substantially total lack of such restraint. With this approach, the skier must frequently successively manually release and secure the heel of his ski boots to the skis, resulting in much difficulty, and often exasperation, on the part of the skier. Further, such an approach is inherently dangerous, since the skier may inadvertently leave the heel of his boot unattached when it should be attached to provide needed control, and vice versa.

Another approach to the problem of providing free vertical movement of the heel while restraining its lateral movement has involved the use of elastic or spring tensioned cables engaging the heel to the ski. This approach, however, does not provide for completely unimpeded vertical movement of the heel, nor does it substantially prevent the undesired lateral movement.

BRIEF SUMMARY AND OBJECTS OF THE INVENTION

With the foregoing in mind, the present invention prevents or substantially alleviates the aforesaid disadvantages of present cross country and mountaineer ski bindings by providing apparatus communicating the ski with the heel of the cross country ski boot, whereby lateral motion of the heel of the boot is substantially prevented when the heel is in close proximity to the upper surface of the ski, while unimpeded vertical movement of the heel is still permitted. Further, the heel is guided by the apparatus into proper orientation with respect to the ski when the heel is lowered into the apparatus. In accordance with one aspect of the invention, the heel of the ski boot is further affirmatively gripped and secured into a central position upon the ski when the heel is lowered into the apparatus, while the desired unimpeded vertical removal of the heel upwardly from the ski is retained.

Accordingly, it is a primary object of the present invention to provide a novel and improved binding for cross country skis.

A paramount object of the invention is to provide an improved restraint for the heel of a cross country ski boot whereby lateral movement of the heel with respect to the ski is substantially prevented.

A further object of the invention is to provide lateral restraint of the heel of a cross country ski boot while permitting completely unimpeded vertical motion of the heel with respect to the ski.

Another object of the invention is to provide for the positive affirmative gripping of the heel of the boot into the desired central location in respect to the ski.

Another significant object of the invention is to provide an improved binding for cross country skis whereby the use of the skis is facilitated for both accomplished and beginning skiers.

Another object of the invention is to provide an improved yet simple and economical improvement to cross country ski bindings.

A still further object of the invention is to provide an improvement in cross country and mountaineer skis which may be readily used in cooperation with available conventional bindings for the toes of cross country and mountaineer ski boots.

A further and significant object of the invention is to provide improved control of cross country and mountaineer skis used in the downhill direction.

Another significant object of the invention is to provide an improved binding for the heel of a cross country ski boot whereby the skier can provide for traveling uphill, level, or downhill upon the snow without making manual adjustments or attachments of the ski to the heel of his boot.

These and further objects and advantages of the present invention will be apparent from the following detailed description of embodiments of the invention made with reference to the accompanying drawings:

DETAILED DESCRIPTION OF ILLUSTRATED EMBODIMENTS

Figure 1:
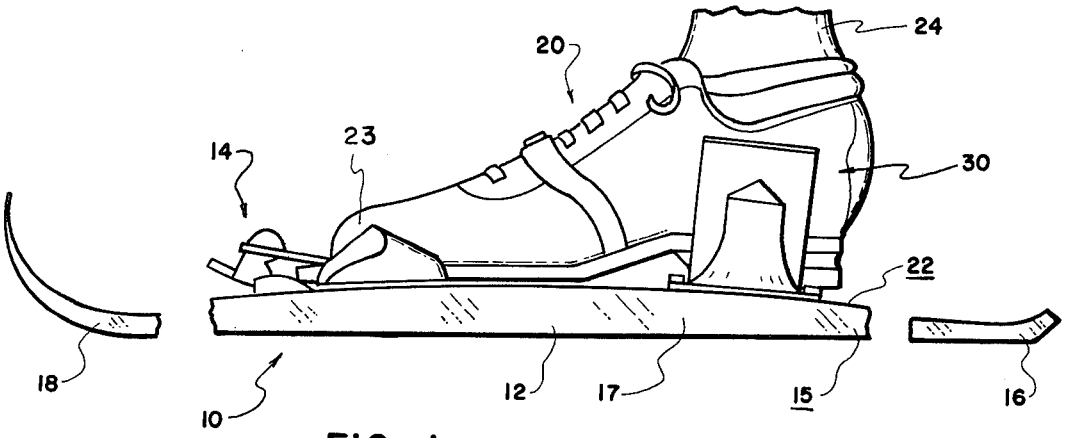
FIG. 1 is a partial representation of a cross country ski showing a boot worn by the user disposed thereon with the heel disposed downward into one embodiment of the heel restrainer.
Figure 2:
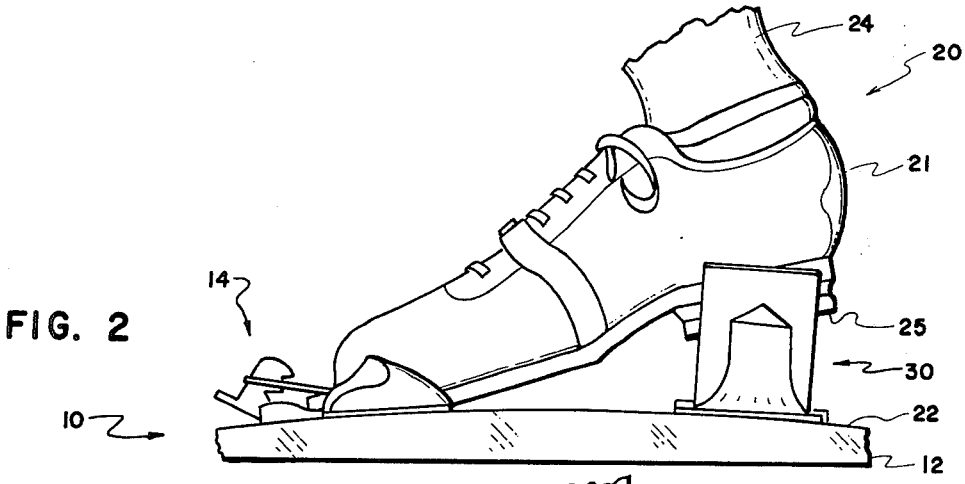
FIG. 2 is a partial representation of the ski of FIG. 1 with the heel of the boot raised partially from the restrainer.

Reference is now made to the Figures wherein like parts are designated by like numerals throughout. FIGS. 1 and 2 in particular illustrate a ski assembly, generally designated 10, comprising an elongated ski 12 having a front curved portion 18 and a rear essentially straight portion 16 and a central portion 17. The ski has a lowermost snow engaging surface 15 and an upper surface 22. A toe binding 14 is provided securing a toe 23 of a boot 20 to the ski 12 when it is used to transport a user thereof along the snow. The binding 14 may be selected from among numerous available toe bindings widely used for cross country skiing or mountaineering skiing. The binding 14 securing the toe 23 of the boot 20 to the ski 12 allows the operator 24 to raise a heel 21 away from the upper surface 22 during use of the ski, as seen in FIG. 2. The boot 20 may be somewhat flexible so as to further promote unrestrained vertical movement of the heel.

It should be understood that typical toe bindings such as the bindings 14 shown in FIG. 1, while firmly holding a toe 23 of the cross country ski boot 20, nevertheless permit substantial rotation of the boot worn by the skier 24. This results in frequent displacement of the heel laterally from the center of the ski as turns, hill climbing, downhill skiing and the like are performed using the cross country or mountaineering ski. Further, many ski boots 20 are themselves inherently somewhat flexible, which fact adds to the problem of lateral movement of the heel from the center of the ski. Lateral movement, of course, in many skiing situations reduces the control of the ski assembly 10 by the skier, since he can apply less controlling torque through the flexible toe bindings than he could were the heel itself restrained against rotation from the center of the ski.

A heel restrainer, seen in FIG. 1 and generally designated 30, and which is the subject of this invention, is rigidly secured to the upper surface 22 of the ski 12. The restrainer 30 illustrated in FIG. 1 is one of three preferred embodiments of the heel restrainer shown in various Figures herein. All illustrated preferred embodiments of the heel restrainer 30 substantially prevent lateral motion of the heel 21 in respect to the ski 12 when the heel 21 is downwardly disposed into the restrainer 30 into close proximity with the upper surface of the ski 12.

The restrainer 30, in all illustrated embodiments, permits free vertical movement of the heel 21 in respect to the ski 12, as can be seen in FIG. 2. The restricted lateral movement of the heel 21, along with the unrestricted vertical movement thereof, greatly facilitates the use of the ski assembly 10 for moving the operator 24 along the snow in the level, uphill, or downhill directions.

Figure 3:
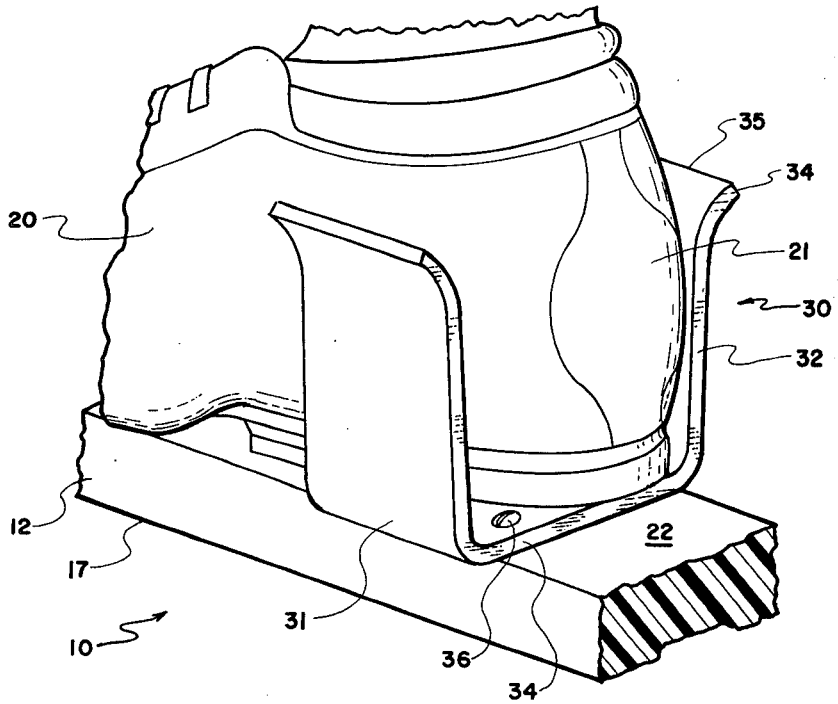
FIG. 3 is an enlarged partial perspective representation of a first and simplified embodiment of the restrainer showing a heel of a boot disposed downwardly thereinto.

The various preferred embodiments of the heel restrainer 30 are now each separately described with reference to the Figures. In FIG. 3 a most simplified preferred embodiment of the heel restrainer 30 is illustrated, the heel 21 of the boot 20 being shown disposed downward into the heel restrainer 30. The heel restrainer 30 comprises an essentially rigid restraining member 31 comprising two spaced apart vertically extending portions 32 being integral with an essentially straight horizontal portion 34 thereof. The portion 34 is in contact with the upper surface 22 of the ski 12, and is rigidly secured to the ski 12 by screws 36 extending through bores, not shown, provided through the portion 34 into bores, not shown, carried by the ski 12.

When the heel 21 is disposed downwardly into the restrainer 30 as seen in FIG. 3, the sides 32 extend substantially upwardly along the sides of the heel 21. The heel 21 is loosely accepted by the opening formed between the sides 32 so that movement of the heel 21 in the vertical direction is unrestrained. However, lateral motion of the heel 21 with respect to the restrainer 30 and the ski 12 is substantially prevented, so that the operator 24 may control the orientation of the ski 12 with greater facility.

The bottom 25 of the heel 21 may during operation of the ski 12 be lifted vertically beyond the top edge 35 of the restrainer 30. Accordingly, outwardly curving portions 34 are provided on the sides 32 to guide the subsequent re-entry of the heel 21 into the restrainer 30. The restrainer member 31 is preferably comprised of thick guage steel or the like, but any rigid material having the requisite strength is equally preferred.

Figure 4:
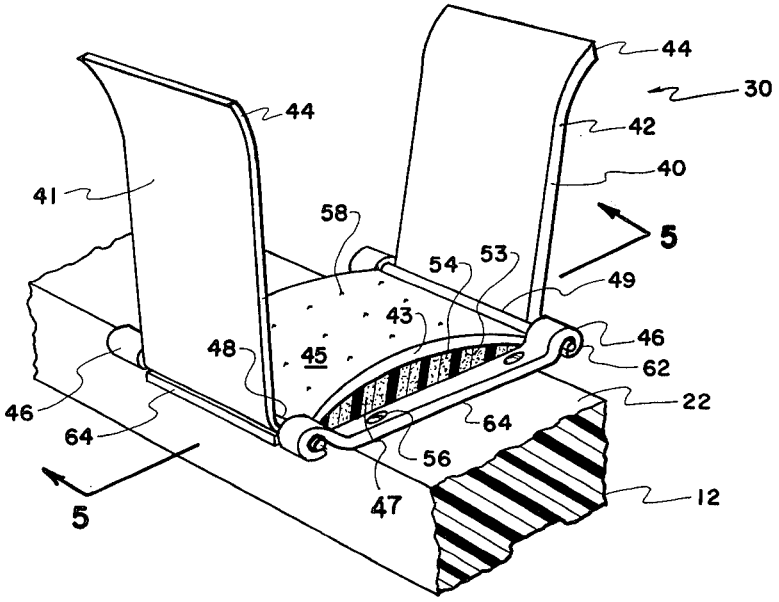
FIG. 4 is an enlarged perspective representation of a second embodiment of the restrainer mounted upon a ski, partially shown.

A second preferred embodiment of the heel restrainer 30 is seen in FIG. 4. The restrainer embodiment 30 seen in FIG. 4 comprises a continuous member 40 having two spaced apart, generally vertically extending members 41 and 42 contiguous with a generally horizontal but upwardly curved lower center portion 43. The center portion 43 is of elastic spring-like material. The spaced apart members 41 and 42 may be angled outwardly from the center of the ski 12 so that the space therebetween is tapering.

The member 40 is configured to comprise channel or groovelike portions 51 and 52 oriented longitudinally to the ski 12 and accepting pins 48 and 49 therein. The pins 48 and 49 are each restrained by clamping portions 46 of a base plate 64 secured to the upper surface 22 of the ski 12 by screws 56 installed in bores, not shown, extending through the plate 64 into bores, not shown, into the ski 12. An upwardly disposed surface 45 of the central portion 43 may carry upwardly extending projections 58, which engage the bottom 25 of the heel 21 of the boot 20, when the heel 21 is placed downwardly into the restrainer 30 onto the portion 43.

Figure 5:
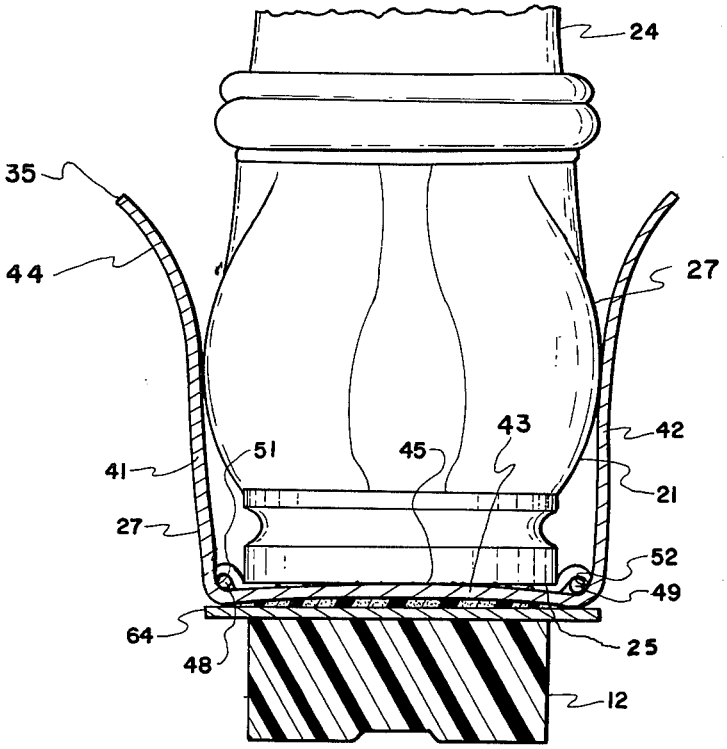
FIG. 5 is a cross-sectional representation of the restrainer of FIG. 3 taken along line 5—5 of FIG. 4, showing also a heel of a boot disposed therein and being gripped by the restrainer.

As best seen in FIG. 5, the bottom 25 of the heel 21 engages the upper surface 45 of the center portion 43, causing the portion 43 to straighten and be deflected generally downwardly. As the portion 43 is thus forced downward, the groovelike portions 52 and 51 communicate essentially pivotally with the pins 48 and 49 so that the upwardly extending portions 41 and 42 are rotated toward the center of the ski 12 to grip the sides 27 of the heel 21. Thus, the heel 21 is firmly held in a central position upon the ski 12 so long as a portion of the weight of the skier 24 is disposed upon the heel 21 of the boot 20. In this manner, the operator 24 of the ski 12 is able to exercise increased control over the ski during its use for climbing, propelling himself forward by frictional engagement of the ski with the snow through the portion 17, or in making turns and the like while skiing downhill.

The aforementioned tapered space between the vertical portions 42 facilitates the entry of the heel 21 thereinto when the heel 21 is lowered vertically from a position which may in some instances be above the top edges 35 of the restrainer 30. To further facilitate the placing of the heel 21 downwardly into the restrainer 30, outwardly curving portions 44 of the vertically extending members 41 and 42 are provided.

Also provided in the second preferred embodiment 30 is a highly compressible body 54 disposed beneath the upwardly curved portion 43 to exclude snow, ice and moisture. Such snow or ice or other foreign material which could otherwise lodge beneath the member 43 could, of course, impede the downward motion of the member 43 as hereinabove described and thus hamper the operation of the heel restrainer 30. The body 54 may comprise a hollow body formed by a closed sheet of flexible, water impervious material, or may comprise foam rubber or the like having its exposed surfaces 47 sealed against the entry of moisture. The body 54 may be bonded to a lower surface 53 of the portion 43, and to the upper surface 22 of the ski 12.

Figure 6:
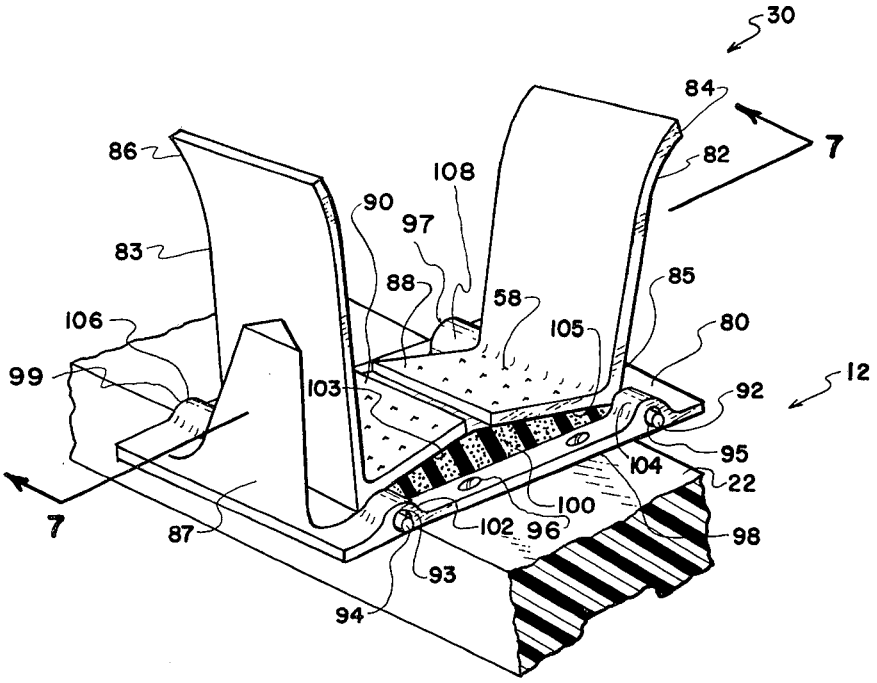
FIG. 6 is an enlarged perspective representation of a third embodiment of the restrainer mounted upon a ski, partially shown.
Figure 7:
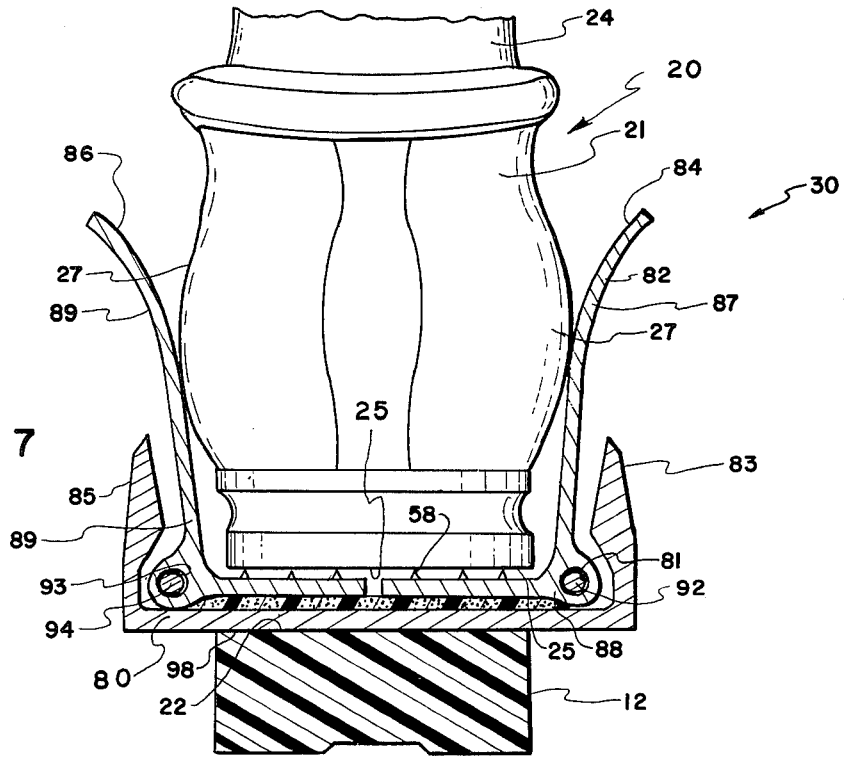
FIG. 7 is a cross-sectional representation of the restrainer of FIG. 6 taken along line 7—7 of FIG. 6, showing also a heel of a ski boot disposed therein and being gripped by the restrainer.

Turning now to FIGS. 6 and 7, a third preferred embodiment of the heel restrainer 30 is seen. The restrainer 30 seen in FIG. 6 and 7 comprises two generally L-shaped, essentially rigid members 82 and 83 carrying spaced apart upwardly extending portions 87 and 89 respectively (See FIG. 7). The member 82 carries a bore 81 into which a pin 92 is press fitted, and the member 83 carries a similar portion 89, a bore 93, and a pin 94. A base 80 is provided, being secured to the upper face 22 of the ski 12 by screws 96 extending through bores, not shown, through the base 80 into bores, not shown, extending into the ski 12. As best seen in FIG. 7, the base 80 has an essentially flat surface 98 which mates with the upper surface 22 of the ski 12.

The base 80 carries also a pair of upwardly extending projections 83 and 85 each longitudinally disposed in respect to the ski 12, which serve as stops as hereinafter described. Knobs or bosses, 104 and 108 carried by the base 80 carry axially aligned bores 95 and 97 accepting the pin 92 at opposite ends thereof. Similarly, the projections 102 and 106 carry axially aligned bores 93 and 99 accepting the opposite ends of the pin 94. Accordingly, the L-shaped members 82 and 83 communicate pivotally with the base 80 through the pins 92 and 94 respectively.

The L-shaped members 82 and 83 are biased rotatably against stops 83 and 85 provided on the base 80 and extending upwardly therefrom. The aforesaid biasing of the L-shaped members 82 and 83 is achieved by the action of a resilient compressible body 100 installed beneath generally horizontal portions 88 and 90 of the L-shaped members 82 and 83. The body 100 may be of foam rubber or other highly compressible resilient material and may be bonded to under surfaces 105 and 103 of the L-shaped members 82 and 83 respectively. The body 100 is, further, inherently water impermiable or may, selectively, be of water absorbant material having all exposed surfaces treated or sealed to prevent the entry of water. Subsequent freezing of absorbed moisture to hamper the rotating action of the L-shaped members is prevented thereby.

The biasing action of the resilient body 100 could be achieved also by the use of compression springs or resilient cantilevered spring members positioned between the lower surfaces 103 and 105 and the upper surface of the base 80 without departing from the essential spirit of the invention.

The particular manner in which the third preferred embodiment of the heel restrainer 30 operates to aid the skier is now described, with reference to FIG. 7. In FIG. 7 a heel 21 of a cross country ski boot 20 is shown placed downwardly into the space formed between the vertical portions 87 and 89 of the L-shaped members 82 and 83. The weight of the skier has acted through the bottom 25 of the boot 21 downwardly upon projections 58 provided on upper surfaces carried by the horizontal portions 88 and 90 of the L-shaped members 82 and 83. The weight of the skier acting through the heel 21 compresses the body 100 so that the outwardly directed biases of the members 82 and 83 have been overcome and the vertical portions of members 82 and 83 made to grip the sides 27 of the heel 21, holding the heel firmly in a central position with respect to the ski 12.

With reference to FIG. 7, it is apparent that the skier may lift the heel of the boot 20 from the ski 12 without such movement being in any way impeded, the heel lifting freely as the L-shaped members 82 and 83 are biased away from each other by the resiliency of the body 100 acting upon the under surfaces 103 and 105 of the horizontal portions 88 and 90.

Note also that the members 82 and 83 when in their fully biased positions against supports 83 and 85 form an upwardly increasing tapering opening therebetween, so that a downwardly placed heel 21 is guided into a position central to the restraint 30 and the ski 12. Outwardly curving portions 84 and 86 of the members 82 and 83 respectively further aid the placement of the heel 21 accurately down into the restrainer 30.

It is evident that, with the previously described embodiment, the restraint 30, by firmly holding the heel into a central position upon the ski 12, aids in the use of the ski in propelling the skier along the snow or in his control of the ski when in downhill motion.

It should be understood that the embodiments of the invention described herein are for illustrative purposes only and that the scope and breadth of the present invention are intended to be defined only by the appended claims, and that any embodiment of the present invention defined by the boundaries of the claims are intended to be embraced therein. All embodiments within the meaning and range of equivalency of the appended claims are intended to be embraced therein. The invention may be embodied in the other specific forms than those illustrated without departing from the spirit or essential characteristics thereof.

What is claimed and desired to be protected by United States Letters Patent is:

1. In combination with a ski assembly which comprises:

an elongated ski having an upper surface and a snow engaging lower surface and a forward portion and a rearward portion, and a suitable binding apparatus carried by the forward portion for securing the toe of a ski boot to the upper surface of the ski, the improvement of a ski boot heel restraining means carried by the ski, the heel restraining means comprising:

a base plate secured to the top surface of the ski by any suitable means:

at least one continuous member disposed upon the base plate comprising:

a pair of side portions thereof extending generally vertically from the base plate and disposed apart from each other so as to define a space therebetween to loosely accept the heel of the boot, and a generally horizontal resilient center portion spanning the space between the vertical portions generally at the lower ends thereof, said center portion being curved upwardly away from the base plate, so that the weight of an operator of the ski acting through the heel upon the resilient raised center portion causes the center portion to lower toward the base plate and the vertical portions of the member to rotate toward the center of the ski so as to grip the heel and to prevent lateral movement thereof and so that the heel is released when subsequently raised from the center portion; and means loosely securing the member to the base plate so that the member is centrally disposed laterally in respect to the ski and the said space is oriented transverse to the ski, said means permitting substantially unimpeded displacement of the center portion of the member a suitable amount upwardly and downwardly and permitting also unimpeded rotation of the vertical portions inwardly and outwardly in respect to the ski.

2. In combination with a ski assembly which comprises:

an elongated ski having an upper surface and a snow engaging lower surface and a forward portion and a rearward portion, and a suitable binding apparatus carried by the forward portion for securing a toe of a ski boot to the upper surface of the ski, the improvement comprising:

ski boot heel restraining means comprising:

a base plate secured to the upper surface of the ski by any suitable means.

at least one pair of substantially rigid members so disposed as to extend generally vertically from the base plate and spaced apart from each other so as to define a space therebetween to accept the heel of the boot, means securing the pair of members to the base plate, said means permitting at least one member of the pair to pivot laterally in respect to the ski, so that the space between the members is changed in extent as said member is caused to pivot, and means biasing the pivoted member generally away from the ski, so that the space between the members of the pair is enlarged so as to permit unimpeded downward insertion of the heel of the boot into the space, the biasing means being such as to be thereafter overcome by the weight of a skier acting downwardly through the heel, so that the enlarged space is decreased when the heel is lowered into the space to the vicinity of the base plate and the heel is gripped between the vertical members, and lateral movement thereof is thus prevented, and so that the heel is released when it is subsequently raised from the vicinity of the base plate.

3. The improvement of claim 2 wherein the biasing means comprises:

a generally horizontal member carried by the pivoted vertical member and extending above and generally parallel to the base plate and toward the center of the ski, and a pad of suitable thickness of suitable resilient material disposed between the base plate and the horizontal portion of the vertical member.

4. The improvement of claim 2 wherein the biasing means comprises:

a generally horizontal portion carried by the pivoted vertical member and extending above the base plate toward the center of the ski, and at least one compression spring of suitable resilient material disposed between the horizontal portion and the base plate, so as to bias the pivoting vertical member outwardly from the center of the ski, and a sheath of suitable resilient material suitable adhered to the horizontal portion and the base plate, so as to exclude moisture, snow and ice from entering between the horizontal portion and the base plate so that the pivoting of the member is not impeded during use of the ski.

5. The improvement of claim 2 further comprising:

a generally vertically extending projection carried by the base plate to restrict the amount of rotation of the pivoted member away from the ski.

6. A ski boot heel restraining apparatus for a cross country ski having an upper surface and a lower snow engaging surface, comprising:

a base plate secured to the upper surface of the ski by any suitable means, at least one pair of members so disposed as to extend generally vertically from the base plate and spaced apart from each other so as to define a space therebetween to accept the heel of the boot, means securing the pair of members to the base plate, said means permitting at least one member of the pair to pivot laterally in respect to the ski, so that the space between the members is changed in extent as said member is caused to pivot, and means biasing the pivoted member generally away from the ski, so that the space between the members of the pair is enlarged so as to permit unimpeded downward insertion of the heel of the boot into the space, the biasing means being such as to be thereafter overcome by the weight of a skier acting downwardly through the heel, so that the enlarged space is decreased when the heel is lowered into the space to the vicinity of the base plate and the heel is gripped between the vertical members and lateral movement of the heel is prevented by the vertical members, and so that the heel is released when it is subsequently raised from the vicinity of the base plate.

7. The apparatus of claim 6, wherein the biasing means comprises:

a generally horizontal member carried by the pivoted vertical member and extending above and generally parallel to the base plate and toward the center of the ski, and a pad of suitable thickness of suitable resilient material disposed between the base plate and the horizontal portion of the vertical member.

8. The apparatus of claim 6, wherein the biasing means comprises:

a generally horizontal portion carried by the pivoted vertical member and extending above the base plate toward the center of the ski, at least one compression spring of suitable resilient material disposed between the horizontal portion and the base plate, so as to bias the pivoting vertical member outwardly from the center of the ski, and a sheath of suitable resilient material suitably adhered to the horizontal portion and the base plate, so as to exclude moisture, snow and ice from entering between the horizontal portion and the base plate so that the pivoting of the member is not impeded during use of the ski.

9. The apparatus of claim 6 further comprising:

a generally vertically extending projection carried by the base plate to restrict the amount of rotation of the pivoted member away from the ski.

10. A ski boot heel restraining apparatus for a cross-country ski having an upper surface and a lower snow engaging surface, comprising:

a base plate secured to the top surface of the ski by any suitable means:

at least one continuous member disposed upon the base plate comprising:

a pair of side portions thereof extending generally vertically from the base plate and disposed apart from each other so as to define a space therebetween to loosely accept the heel of the boot placed downwardly thereinto: and a generally horizontal resilient center portion spanning the space between the vertical portions generally at the lower ends thereof, said center portion being curved upwardly away from the base plate, so that the weight of an operator of the ski acting through the heel upon the resilient raised center portion causes the center portion to lower toward the base plate and the vertical portions of the member to rotate toward the center of the ski so as to grip the heel and to prevent lateral movement thereof, and so that the heel is released when subsequently raised from the center portion; and means loosely securing the member to the base plate so that the member is centrally disposed laterally in respect to the ski and the said space is oriented transverse to the ski, said means permitting substantially unimpeded displacement of the center portion of the member a suitable amount upwardly and downwardly and permitting also unimpeded rotation of the vertical portions inwardly and outwardly in respect to the ski.

* * * * *